US007116226B1

(12) United States Patent
Pollard

(10) Patent No.: US 7,116,226 B1
(45) Date of Patent: Oct. 3, 2006

(54) CASH REGISTER ALARM SYSTEM

(76) Inventor: William Reginald Pollard, 2615 Firethorn Path, Spring Branch, TX (US) 78070

( * ) Notice: Subject to any disclaimer, the term of this patent is extended or adjusted under 35 U.S.C. 154(b) by 133 days.

(21) Appl. No.: 10/752,925

(22) Filed: Jan. 7, 2004

(51) Int. Cl.
*G08B 13/14* (2006.01)

(52) U.S. Cl. ..... 340/570; 340/568.1; 340/545.6; 200/61.61; 200/61.19; 235/379; 235/380

(58) Field of Classification Search ..... 340/570, 340/568.1, 546, 555, 600, 691.1, 571, 572.1, 340/533, 572.3, 545.6; 200/61.61, 61.19; 109/39; 235/379, 380
See application file for complete search history.

(56) References Cited

U.S. PATENT DOCUMENTS 3,618,060 A 11/1971 Nina
3,638,213 A * 1/1972 Dagle ..... 340/568.1
3,730,110 A * 5/1973 Peters ..... 109/25
3,828,166 A 8/1974 Johansson et al.
4,054,752 A 10/1977 Dennis, Jr. et al.
4,070,564 A * 1/1978 Tucker ..... 705/18
4,242,670 A * 12/1980 Smith ..... 340/555
D258,365 S 2/1981 Clary et al.
5,281,952 A * 1/1994 Dragan ..... 340/546
5,512,877 A * 4/1996 Gels et al. ..... 340/570

* cited by examiner

*Primary Examiner*—Thomas Mullen
*Assistant Examiner*—Daniel Previl

(57) ABSTRACT

A cash register alarm system for sounding an alarm to the police without delay. The cash register alarm system includes a cash drawer having a bottom wall and a back wall, and also includes a tray having a bottom wall and a back wall and plurality of partitions spaced apart and forming compartments therebetween, and further includes a plurality of sensors disposed in the compartments in the bottom wall of the tray, and also includes a plurality of electrical current contact members disposed upon the back walls of the cash drawer and the tray. More than one compartment without paper money will expose the sensors to light which will acutate the alarm system to the police.

2 Claims, 2 Drawing Sheets

CASH REGISTER ALARM SYSTEM

BACKGROUND OF THE INVENTION

1. Field of the Invention

The present invention relates to a silent alarm system for a cash drawer and more particularly pertains to a new cash register alarm system for sounding an alarm to the police without delay.

2. Description of the Prior Art

The use of silent alarm system for a cash drawer is known in the prior art. More specifically, silent alarm system for a cash drawer heretofore devised and utilized are known to consist basically of familiar, expected and obvious structural configurations, notwithstanding the myriad of designs encompassed by the crowded prior art which have been developed for the fulfillment of countless objectives and requirements.

Known prior art includes U.S. Pat. No. 5,512,877; U.S. Pat. No. 3,618,060; U.S. Pat. No. 3,828,166; U.S. Pat. No. 4,070,564; U.S. Pat. No. 4,054,752; and U.S. Pat. No. Des. 258,365.

While these devices fulfill their respective, particular objectives and requirements, the aforementioned patents do not disclose a new cash register alarm system. The inventive device includes a cash drawer having a bottom wall and a back wall, and also includes a tray having a bottom wall and a back wall and plurality of partitions spaced apart and forming compartments therebetween, and further includes a plurality of sensors disposed in the compartments in the bottom wall of the tray, and also includes a plurality of electrical current contact members disposed upon the back walls of the cash drawer and the tray. More than one compartment without paper money will expose the sensors to light which will acutate the alarm system to the police.

In these respects, the cash register alarm system according to the present invention substantially departs from the conventional concepts and designs of the prior art, and in so doing provides an apparatus primarily developed for the purpose of sounding an alarm to the police without delay.

SUMMARY OF THE INVENTION

In view of the foregoing disadvantages inherent in the known types of silent alarm system for a cash drawer now present in the prior art, the present invention provides a new cash register alarm system construction wherein the same can be utilized for sounding an alarm to the police without delay.

The general purpose of the present invention, which will be described subsequently in greater detail, is to provide a new cash register alarm system which has many of the advantages of the silent alarm system for a cash drawer mentioned heretofore and many novel features that result in a new cash register alarm system which is not anticipated, rendered obvious, suggested, or even implied by any of the prior art silent alarm system for a cash drawer, either alone or in any combination thereof.

To attain this, the present invention generally comprises a cash drawer having a bottom wall and a back wall, and also includes a tray having a bottom wall and a back wall and plurality of partitions spaced apart and forming compartments therebetween, and further includes a plurality of sensors disposed in the compartments in the bottom wall of the tray, and also includes a plurality of electrical current contact members disposed upon the back walls of the cash drawer and the tray. More than one compartment without paper money will expose the sensors to light which will acutate the alarm system to the police.

There has thus been outlined, rather broadly, the more important features of the invention in order that the detailed description thereof that follows may be better understood, and in order that the present contribution to the art may be better appreciated. There are additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new cash register alarm system which has many of the advantages of the silent alarm system for a cash drawer mentioned heretofore and many novel features that result in a new cash register alarm system which is not anticipated, rendered obvious, suggested, or even implied by any of the prior art silent alarm system for a cash drawer, either alone or in any combination thereof.

It is another object of the present invention to provide a new cash register alarm system which may be easily and efficiently manufactured and marketed.

It is a further object of the present invention to provide a new cash register alarm system which is of a durable and reliable construction.

An even further object of the present invention is to provide a new cash register alarm system which is susceptible of a low cost of manufacture with regard to both materials and labor, and which accordingly is then susceptible of low prices of sale to the consuming public, thereby making such cash register alarm system economically available to the buying public.

Still yet another object of the present invention is to provide a new cash register alarm system which provides in the apparatuses and methods of the prior art some of the advantages thereof, while simultaneously overcoming some of the disadvantages normally associated therewith.

Still another object of the present invention is to provide a new cash register alarm system for sounding an alarm to the police without delay.

Yet another object of the present invention is to provide a new cash register alarm system which includes a cash drawer having a bottom wall and a back wall, and also includes a tray having a bottom wall and a back wall and plurality of partitions spaced apart and forming compartments therebetween, and further includes a plurality of sensors disposed in the compartments in the bottom wall of the tray, and also includes a plurality of electrical current contact members disposed upon the back walls of the cash drawer and the tray. More than one compartment without paper money will expose the sensors to light which will acutate the alarm system to the police.

Still yet another object of the present invention is to provide a new cash register alarm system that sends an alarm to the police without the robber even knowing about it.

Even still another object of the present invention is to provide a new cash register alarm system that is effective and very indiscreet.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be made to the accompanying drawings and descriptive matter in which there are illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
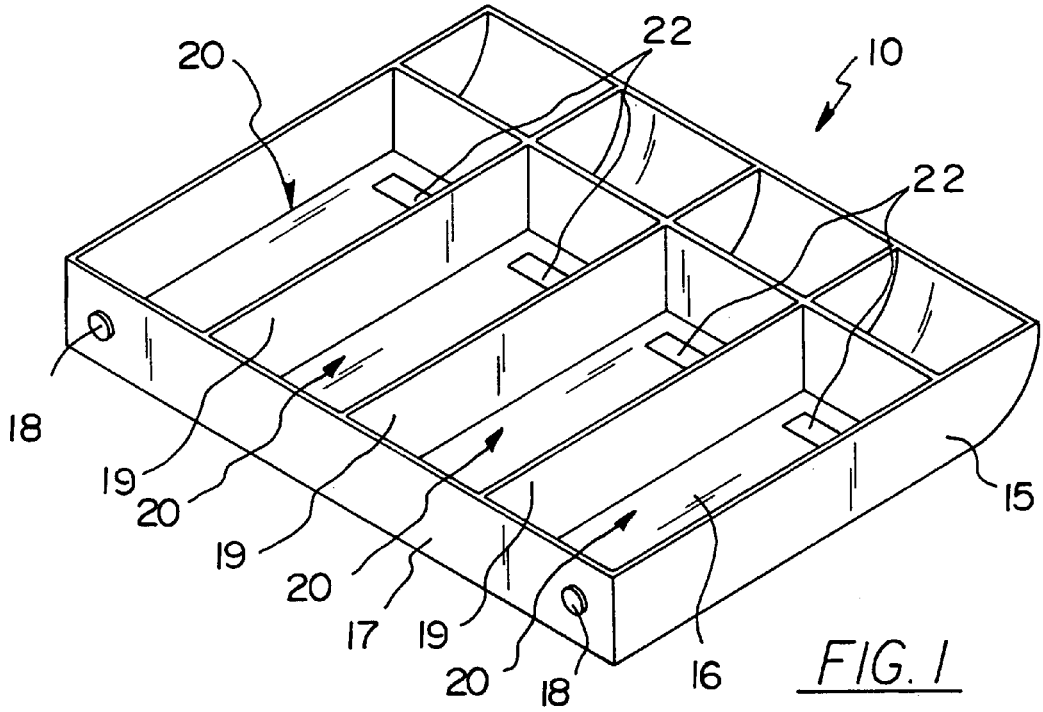
FIG. 1 is a perspective view of tray of a new cash register alarm system according to the present invention.
Figure 2:
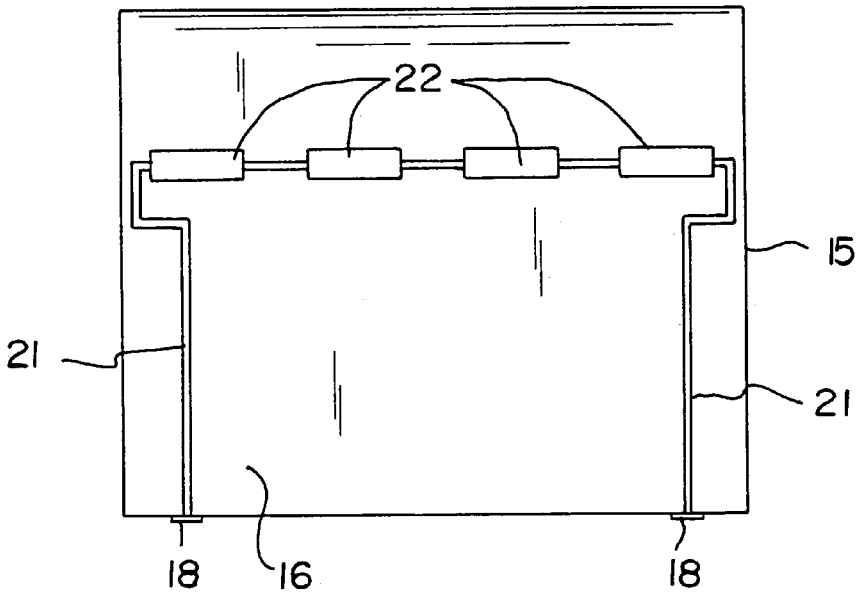
FIG. 2 is a top plan view of the tray of the present invention.
Figure 3:
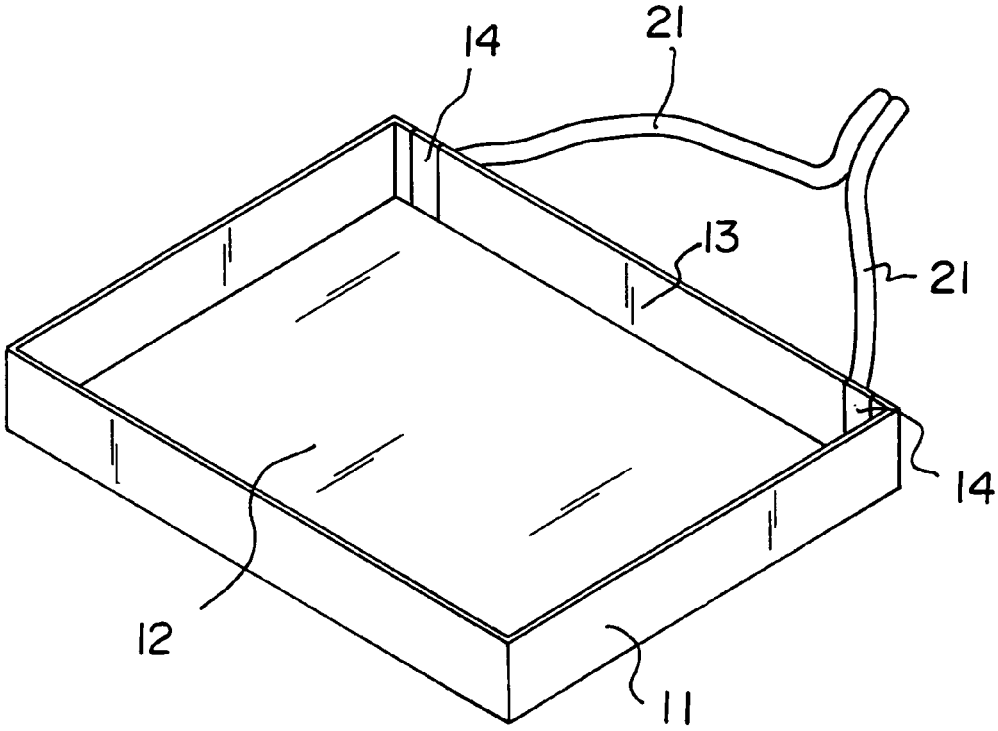
FIG. 3 is a perspective view of cash drawer of the present invention.
Figure 4:
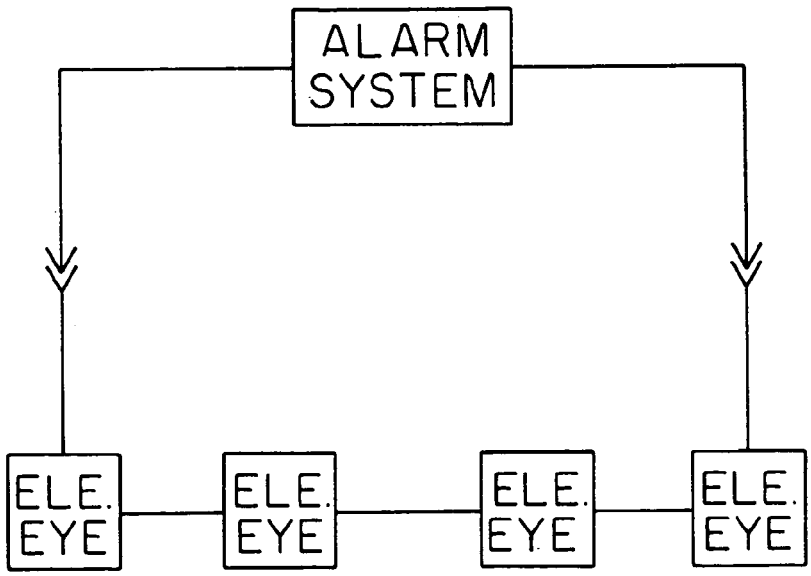
FIG. 4 is a schematic view of the present invention.

With reference now to the drawings, and in particular to FIGS. 1 through 4 thereof, a new cash register alarm system embodying the principles and concepts of the present invention and generally designated by the reference numeral 10 will be described.

As best illustrated in FIGS. 1 through 4, the cash register alarm system 10 generally comprises a cash drawer 11 having a back wall 13 and a bottom wall 12, and further comprises a tray 15 having a bottom wall 16 and a back wall 17 and being removeably disposed upon the bottom wall 12 of the cash drawer 11 with the tray 15 further having a plurality of partitions 19 spaced apart and forming compartments 20 in the tray 15. A plurality of sensors 22 are conventionally disposed in the compartments 20 and in the bottom wall 16 of the tray 15 for detecting whether the compartments 20 have any paper money contained therein. A plurality of electrical current contact members 14,18 are securely and conventionally disposed upon the back wall 17 of the tray 15 and upon the back wall 13 of the cash drawer 11. The electrical current contact members 18 disposed upon the tray 15 are connected to the sensors 22 with wires 21, and the electrical current contact members 14 disposed upon the cash drawer 11 are connected to the alarm system with wires 21. Each of the electrical current contact members 18 of the tray 15 is in contactable relationship with a respective one of the electrical current contact members 18 of the cash drawer 11. The sensors 22 are connected to one another in series such that more than one of the sensors 22 would need to be actuated before an electrical impulse would be transmitted to the alarm system. The sensors 22 are essentially light-sensitive detectors which are actuated when they are exposed to light when the compartments 20 have no paper money to block the light to the sensors 22. The light-sensitive detectors are interconnected with wires 21 with the electrical current contact members 18 of the tray 15 being conventionally disposed on an exterior of the back wall 17 thereof, and the electrical current contact members 14 of the cash drawer 11 being conventionally disposed on an interior of the back wall 13 thereof. Each of the electrical current contact members 14 of the cash drawer 11 are aligned and are in contactable relationship with a respective one of the electrical current contact members 18 of the tray 15 so that the alarm system is connected to the sensors 22.

In use, the tray 15 is placed in the cash drawer 11 so that the electrical current contact members 14,18 of the tray 15 and the cash drawer 11 are touching and in contact with one another to create a complete circuit from the sensors 22 to the alarm system. In order not to actuate the alarm system, the user places paper money in the compartments 20 over the sensors 22 thus blocking out light to the sensors 22. More than one of the compartments 20 would have to be emptied of the paper money before the alarm system would be actuated.

As to a further discussion of the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

I claim:

1. A cash register alarm system comprising:

a cash drawer having a back wall and a bottom wall;

a tray having a bottom wall and a back wall and being removeably disposed upon said bottom wall of said cash drawer, said tray further having a plurality of partitions spaced apart and forming compartments in said tray;

a plurality of sensors disposed in said compartments for detecting the presence of paper money in said compartment; and wherein each said sensor of said plurality of sensors is a light-sensitive detector actuated when said sensor is exposed to light;

wherein each said sensor of said plurality of sensors is mounted on said bottom wall of said compartment of said tray such that placement of paper money in said compartment blocks light from reaching said sensor and removal of paper money from the compartment exposes said sensor to light;

a plurality of electrical current contact members disposed upon said back wall of said tray and upon said back wall of said cash drawer, said electrical current contact members disposed upon said tray being connected to said sensors with wires, said electrical current contact members disposed upon said cash drawer being connected to the alarm system with wires, each of said electrical current contact members of said tray being in contactable relationship with a respective one of said electrical current contact members of said cash drawer, said sensors being connected to one another in series such that more than one of said sensors would need to be actuated before an electrical impulse would be transmitted to the alarm system, said light-sensitive detectors being interconnected with wires, said electrical current contact members of said tray being disposed on an exterior of said back wall thereof, said electrical current contact members of said cash drawer being disposed on an interior of said back wall thereof, each of said electrical current contact members of said cash drawer being aligned and in contactable relationship with a respective one of said electrical current contact members of said tray so that the alarm system is connected to said sensors.

2. The cash register alarm system of claim 1 wherein said tray has four compartments, one of said sensors being positioned in each of said compartments, each of said compartments being further subdivided by a medial partition positioned at a spaced location from said back wall of said tray, each of said sensors being located adjacent to said medial partition.

* * * * *